US009964086B2

(12) United States Patent
Zhang

(10) Patent No.: US 9,964,086 B2
(45) Date of Patent: May 8, 2018

(54) FUEL INJECTOR AND METHOD

(71) Applicant: Ford Global Technologies, LLC, Dearborn, MI (US)

(72) Inventor: Xiaogang Zhang, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 230 days.

(21) Appl. No.: 14/789,561

(22) Filed: Jul. 1, 2015

(65) Prior Publication Data

US 2017/0002783 A1 Jan. 5, 2017

(51) Int. Cl.

| | |
|---|---|
| ***F02M 61/10*** | (2006.01) |
| ***F02M 61/16*** | (2006.01) |
| ***F02M 61/18*** | (2006.01) |
| *B05B 3/06* | (2006.01) |

(52) U.S. Cl.

CPC ..... *F02M 61/10* (2013.01); *F02M 61/18* (2013.01); *F02M 61/161* (2013.01); *F02M 61/168* (2013.01); *F02M 61/1806* (2013.01); *F02M 2200/8076* (2013.01)

(58) Field of Classification Search

CPC ..... F02M 61/10; F02M 61/168; F02M 61/18; F02M 61/1886; F02M 67/10; B05B 3/06; B05B 3/066

See application file for complete search history.

(56) References Cited

U.S. PATENT DOCUMENTS

| | | | | |
|---|---|---|---|---|
| 1,856,089 | A * | 5/1932 | James | F02M 61/045 239/262 |
| 4,502,635 | A | 3/1985 | Klomp et al. | |
| 4,993,643 | A | 2/1991 | Schechter et al. | |
| 5,878,962 | A | 3/1999 | Shen et al. | |
| 6,029,913 | A | 2/2000 | Stroia et al. | |
| 6,513,730 | B1 | 2/2003 | Okojie | |

FOREIGN PATENT DOCUMENTS

WO 2014052126 A1 4/2014

* cited by examiner

*Primary Examiner* — Darren W Gorman
(74) *Attorney, Agent, or Firm* — Julia Voutyras; McCoy Russell LLP

(57) ABSTRACT

Embodiments may provide a fuel injector including a nozzle body having one or more nozzles, each capable of spraying a fuel from a respective spray position, and movable to change the spray position from a first position to a second position. An injector needle may be configured for axial movement relative to the nozzle body from an engaged position, to prevent flow through the one or more nozzles, to a disengaged position. The movement of the one or more nozzles from the first position to the second position and then back to the first position may substantially correspond with, and/or may be substantially be determined by, the relative axial movement between the injector needle and the nozzle body from the engaged position to the disengaged position and then back to the engaged position.

4 Claims, 7 Drawing Sheets

FUEL INJECTOR AND METHOD

FIELD

The present application relates to fuel injectors and to fuel spreading in a combustion chamber of an internal combustion engine.

BACKGROUND AND SUMMARY

Fuel injectors are typically used with internal combustion engines to spray a combustible fuel into a combustion chamber to mix with charge air brought in through an intake passage. There are a number of issues associated with typical injector designs. One is that the fuel sprayed into the chamber may hit the wall of the combustion chamber. This may be due to spray penetration that is too long. In addition, there may be poor air fuel mixing.

U.S. Pat. No. 6,029,913 discloses a swirl tip injector nozzle encompassing a plurality of curvilinear spray holes resulting in fuel flowing through a tangential flow path within the spray hole and thus rapid spreading and breakup of the fuel spray upon exiting the spray hole.

The inventors herein have recognized a number of shortcomings with this approach. For example, this approach does not appear to have reliable control and/or repeatability of the spray pattern from one combustion event to the next. The swirl tip injector nozzle appears to spin in an uncontrolled way to an unpredictable orientation. Accordingly, the orientation of the injection spray nozzle(s) at the start of a second combustion event may be different than for the first event, and so on for subsequent events.

Further, with this approach, no axial movement of the nozzles is contemplated. Accordingly the spray pattern contemplated or made possible with U.S. Pat. No. 6,029,913 is limited.

The present disclosure provides a fuel injector and fuel injector arrangement wherein the fuel nozzle movement for a second and subsequent combustion event may be reliably repeated.

And, the present disclosure provides a fuel injector and fuel injector arrangement and method wherein the fuel nozzle movement may be in one or both of a rotating direction and axial direction. In this way, a fuel injection spray pattern, once determined to meet predetermined criteria, may be reliably repeated for substantially all combustion events. Further, a wider range of possible spay patterns may be possible. For example, without limitation, a circular pattern or a spiral pattern.

Embodiments in accordance with the present disclosure may provide a fuel injector including a nozzle body having one or more nozzles. Each may be capable of spraying a fuel from a respective spray position. The nozzle body may be movable to change the spray position from a first position to a second position. An injector needle may be configured for axial movement relative to the nozzle body from an engaged position, to prevent flow through the one or more nozzles, to a disengaged position to allow flow through the one or more nozzles. The movement of the one or more nozzles from the first position to the second position and then back to the first position may substantially correspond with, and/or may be substantially be determined by, the relative axial movement between the injector needle and the nozzle body from the engaged position to the disengaged position and then back to the engaged position. In this way fuel is less likely to hit the chamber wall, and/or better air fuel mixture may occur.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
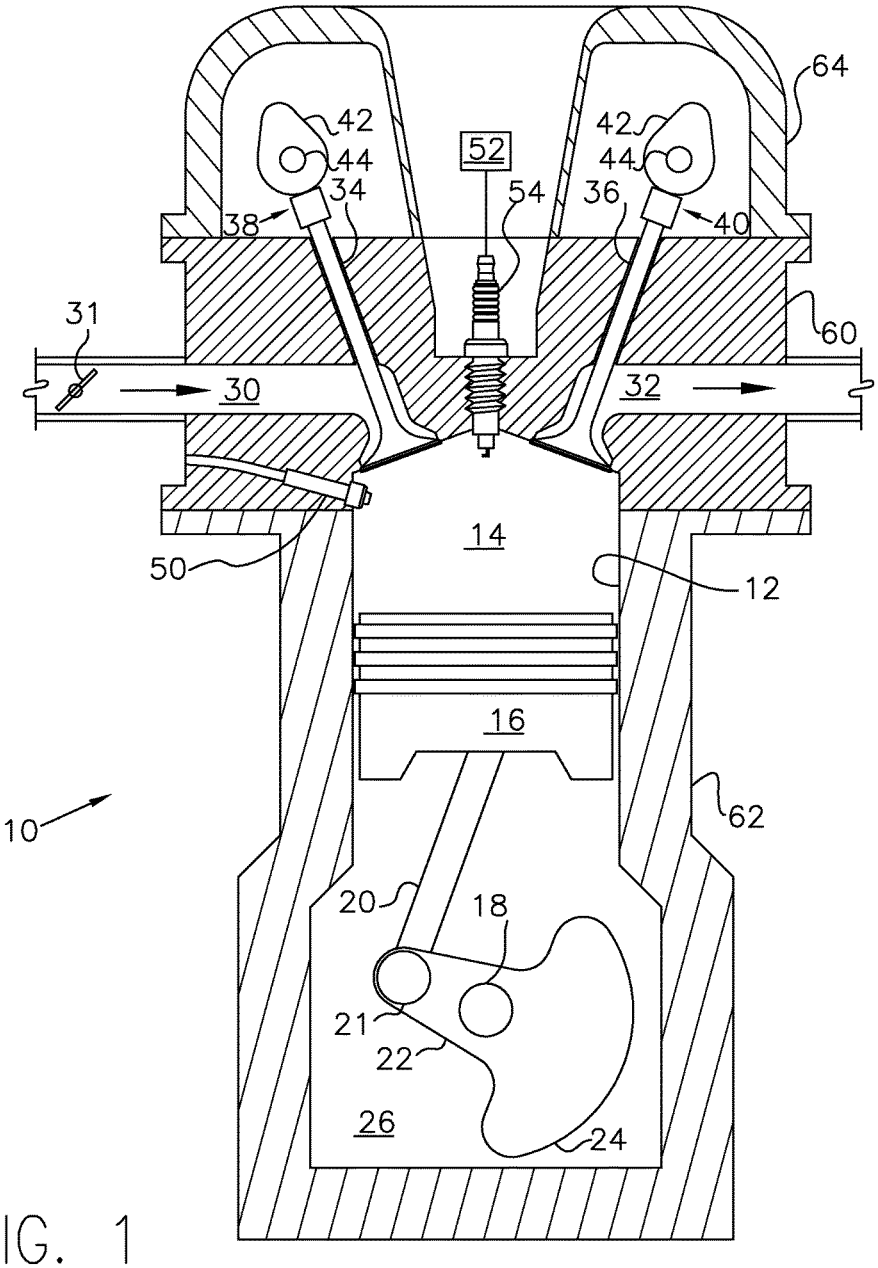
FIG. 1 is a schematic diagram of an example system in accordance with the present disclosure.

FIG. 1 is a cross-sectional diagram illustrating a cross-section of an engine 10 in accordance with the present disclosure. Various features of the engine may be omitted, or illustrated in a simplified fashion for ease of understanding of the current description. For example, areas may include continuous cross hatching that may otherwise indicate a solid body, however actual embodiments may include various engine components, and/or hollow, or empty, portions of the engine with the cross hatched areas.

FIG. 1 is a cross-sectional view through one cylinder 12 of the engine 10. Various components of the engine 10 may be controlled at least partially by a control system that may include a controller (not shown), and/or by input from a vehicle operator via an input device such as an accelerator pedal (not shown). The cylinder 12 may include a combustion chamber 14. A piston 16 may be positioned within the cylinder 12 for reciprocating movement therein. The piston 16 may be coupled to a crankshaft 18 via a connecting rod 20, a crank pin 21, and a crank throw 22 shown here combined with a counterweight 24. Some examples may include a discrete crank throw 22 and counterweight 24. The reciprocating motion of the piston 16 may be translated into rotational motion of the crankshaft 18. The crankshaft 18, connecting rod 20, crank pin 21, crank throw 22, and counterweight 24, and possibly other elements not illustrated may be housed in a crankcase 26. The crankcase 26 may hold oil. Crankshaft 18 may be coupled to at least one drive wheel of a vehicle via an intermediate transmission system. Further, a starter motor may be coupled to crankshaft 18 via a flywheel to enable a starting operation of engine 10.

Combustion chamber 14 may receive intake air from an intake passage 30. Or intake passage, and may exhaust combustion gases via exhaust passage 32. Intake passage 30 and exhaust passage 32 may selectively communicate with combustion chamber 14 via respective intake valve 34 and exhaust valve 36. A throttle 31 may be included to control an amount of air that may pass through the intake passage 30. In some embodiments, combustion chamber 14 may include two or more intake valves and/or two or more exhaust valves.

In this example, intake valve 34 and exhaust valve 36 may be controlled by cam actuation via respective cam actuation systems 38 and 40. Cam actuation systems 38 and 40 may each include one or more cams 42 and may utilize one or more of cam profile switching (CPS), variable cam timing (VCT), variable valve timing (VVT) and/or variable valve lift (VVL) systems that may be operated by the controller to vary valve operation. The cams 42 may be configured to rotate on respective revolving camshafts 44. As depicted, the camshafts 44 may be in a double overhead camshaft (DOHC) configuration, although alternate configurations may also be possible. The position of intake valve 34 and exhaust valve 36 may be determined by position sensors (not shown). In alternative embodiments, intake valve 34 and/or exhaust valve 36 may be controlled by electric valve actuation. For example, cylinder 16 may include an intake valve controlled via electric valve actuation and an exhaust valve controlled via cam actuation including CPS and/or VCT systems.

In one embodiment, twin independent VCT may be used on each bank of a V-engine. For example, in one bank of the V, the cylinder may have an independently adjustable intake cam and exhaust cam, where the cam timing of each of the intake and exhaust cams may be independently adjusted relative to crankshaft timing.

Fuel injector 50 is shown coupled directly to combustion chamber 14 for injecting fuel directly therein in proportion to a pulse width of a signal that may be received from the controller. In this manner, fuel injector 50 provides what is known as direct injection of fuel into combustion chamber 14. The fuel injector 50 may be mounted in the side of the combustion chamber 14 or in the top of the combustion chamber 14, for example. Fuel may be delivered to fuel injector 50 by a fuel system (not shown) including a fuel tank, a fuel pump, and a fuel rail. In some embodiments, combustion chamber 14 may alternatively or additionally include a fuel injector arranged in intake passage 30 in a configuration that provides what is known as port injection of fuel into the intake port upstream of combustion chamber 14.

Ignition system 52 may provide an ignition spark to combustion chamber 14 via spark plug 54 in response to a spark advance signal from the controller, under select operating modes. Though spark ignition components are shown, in some embodiments the combustion chamber 14 or one or more other combustion chambers of engine 10 may be operated in a compression ignition mode, with or without an ignition spark.

Cylinder head 60 may be coupled to a cylinder block 62. The cylinder head 60 may be configured to operatively house, and/or support, the intake valve(s) 34, the exhaust valve(s) 36, the associated valve actuation systems 38 and 40, and the like. Cylinder head 60 may also support camshafts 44. A cam cover 64 may be coupled with and/or mounted on the cylinder head 60 and may house the associated valve actuation systems 38 and 40, and the like. Other components, such as spark plug 54 may also be housed and/or supported by the cylinder head 60. The cylinder block 62, or engine block, may be configured to house the piston 16. While FIG. 1 shows only one cylinder 12 of a multi-cylinder engine 10, each cylinder 12 may similarly include its own set of intake/exhaust valves, fuel injector, spark plug, etc.

A cam cover 64 may be coupled with the cylinder block 60. An oil separator (not shown) may be included with or located under the cam cover 64. One or more baffles (not shown) may be included.

A turbo compressor (not shown) may be disposed on an induction air path for compressing an induction fluid before the induction fluid is passed to the intake passage 30 of the engine 10. In some applications, an inter-cooler (not shown) may be included to cool the intake charge before it enters the engine. The turbo compressor may be driven by an exhaust turbine which may be driven by exhaust gasses leaving the exhaust manifold 32. In some cases, the throttle 31 may be downstream from the turbo compressor instead of upstream as illustrated. Although not illustrated, the engine 10 may include an exhaust gas recirculation EGR line and/or EGR system.

Oil subsystems may utilize oil flow to perform some function, such as lubrication, actuation of an actuator, etc. Example, subsystems may include lubrication systems, such as passageways for delivering oil to moving components, such as the camshafts, cylinder valves, etc. Other oil subsystems may include hydraulic systems with hydraulic actuators and hydraulic control valves. There may be fewer or more oil subsystems than as shown in the illustrated example.

Figure 2A:
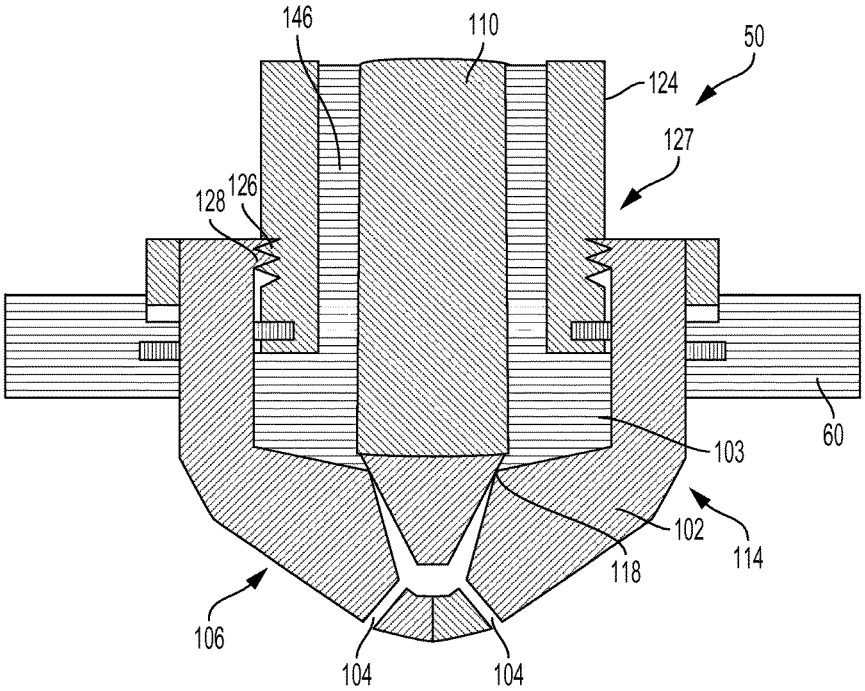
FIG. 2A is a cross-sectional diagram of first example fuel injector in a first position in accordance with the present disclosure.
Figure 2B:
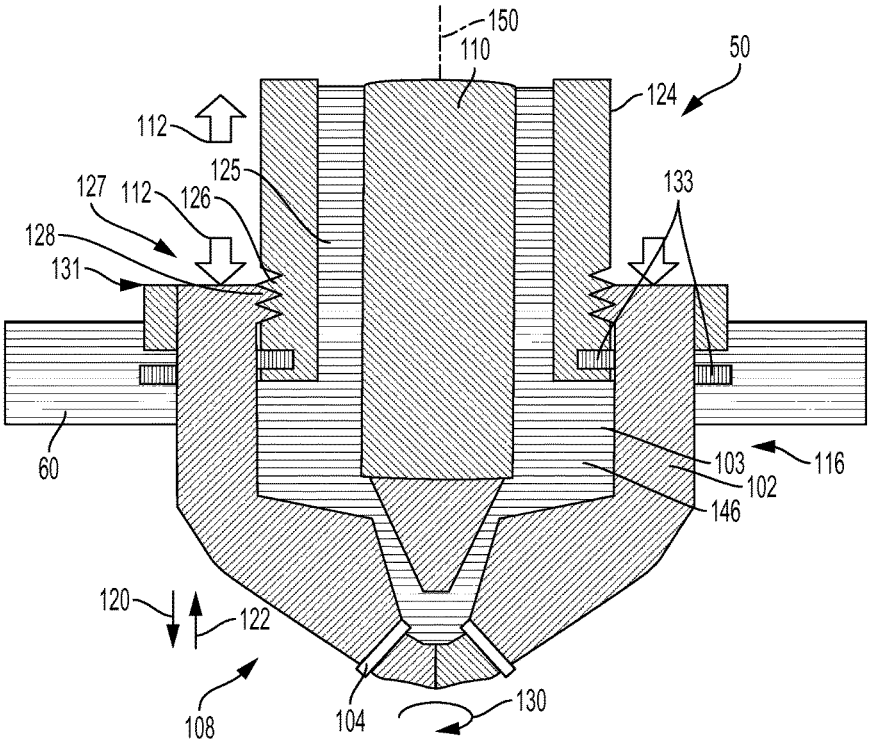
FIG. 2B is a cross-sectional diagram of the fuel injector shown in FIG. 2A in a second position in accordance with the present disclosure.

FIG. 2A illustrates an example fuel injector 50 in a first position, and FIG. 2B is a cross-sectional diagram of the same example fuel injector in a second position in accordance with the present disclosure. The injector 50 may include a nozzle body 102. The nozzle body 102 may have one or more nozzles 104. Each nozzle 104 may be capable of spraying a fuel 103 from a respective spray position. The fuel 103 may be a high pressure fuel 103. The nozzle body 102 may be movable to change the spray position from a first position 106, as illustrated in FIG. 2A, to a second position 108 relative to a fixed point. FIG. 2B may be considered to illustrated an example second position 108. The fixed point may be any location in the engine 10 and/or on the fuel injector 50 itself. The fixed point may be a datum point determined upon manufacture, or assembly, or the like, of the fuel injector 50.

The fuel injector 50 may include an injector needle 110. The injector needle 110 may be configured for axial movement relative to the nozzle body 102, as illustrated with arrows 112, from an engaged position 114 (FIG. 2A) preventing flow through the one or more nozzles 104 to a disengaged position 116 allowing flow through the one or more nozzles 104. The engaged position may be characterized as when the injector needle 110 and the nozzle body are in contact at, for example, a seating line 118. The movement of the one or more nozzles 104 from the first position 106 to the second position 108 and then back to the first position 106 may substantially corresponds with, and/or may be substantially determined by, the relative axial movement 112 between the injector needle 110 and the nozzle body 102 from the engaged position 114 to the disengaged position 116 and then back to the engaged position 114. In some cases the injector needle 110 may be fixed.

In various embodiments the movement of the spray position from the first position 106 to the second position 108 may be along a fixed path in a first direction 120, and the movement of the spray position from the second position 108 to the first position 106 may be along the fixed path in a second direction 122 opposite the first direction 120.

Various embodiments may include an injector body 124 having a passage 125 therethrough through which the injector needle 110 is disposed. The injector body 124 may have a first threaded portion 126. The nozzle body 102 may have a second threaded portion 128 threadably engaged with the first threaded portion 126. As illustrated in FIG. 2B the relative movement between the injector needle 110 and the nozzle body 102 may be axial movement 120, 122 of the nozzle body 102 effected by relative axial rotation 130 between the injector body 124 and the nozzle body 102 and consequent threaded interaction between the first and second threaded portions 126, 128. The relative axial rotation 130 between the injector body 124 and the nozzle body 102 may be effected by various means, for example by a motor which may also be used for fuel injection. In some example embodiments the nozzle body 102 may be fixed or otherwise attached to, for example the cylinder head 60 of an engine 10 and the axial movement of the nozzle body may be effected by axial rotation of the injector body 124. In other example embodiments, for example as illustrated in FIG. 1, the axial movement of the nozzle body may be effected by axial rotation, as shown with arrow 130, of the nozzle body 102, and the injector body 124 may be fixed. In some examples, the resultant spray path may be spiral shaped, for example.

The fuel injector 50, in accordance with present disclosure, may include various other elements. A vertical motion guard 131 may be included to govern, and or arrest relative vertical movement of one or both of the injector body 124 and the nozzle body 102. One or more sealing rings 133 may be included which may serve to prevent leakage of the fuel 103 between mating components.

Figure 3:
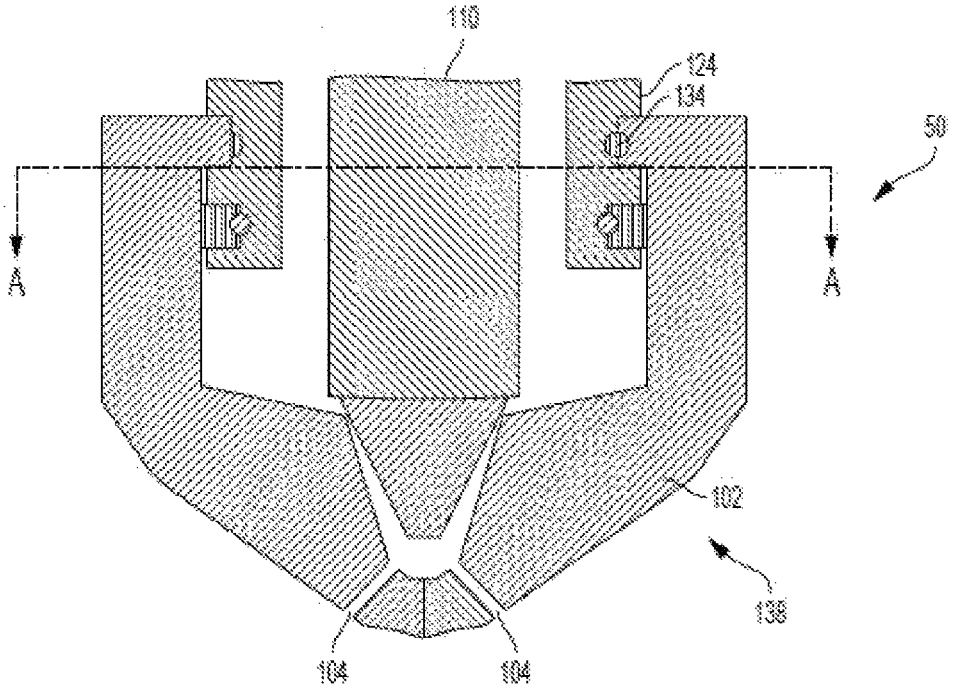
FIG. 3 is a cross-sectional diagram of second example fuel injector in a first position in accordance with the present disclosure.
Figure 4:
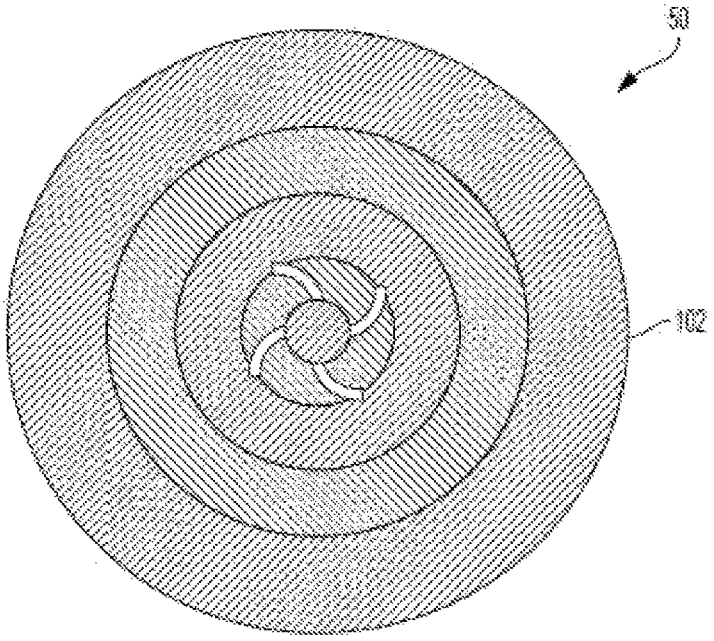
FIG. 4 is a cross-sectional diagram of the second example fuel injector shown in FIG. 3 cut along selected one or more plans to illustrate selected features in accordance with the present disclosure.
Figure 5:
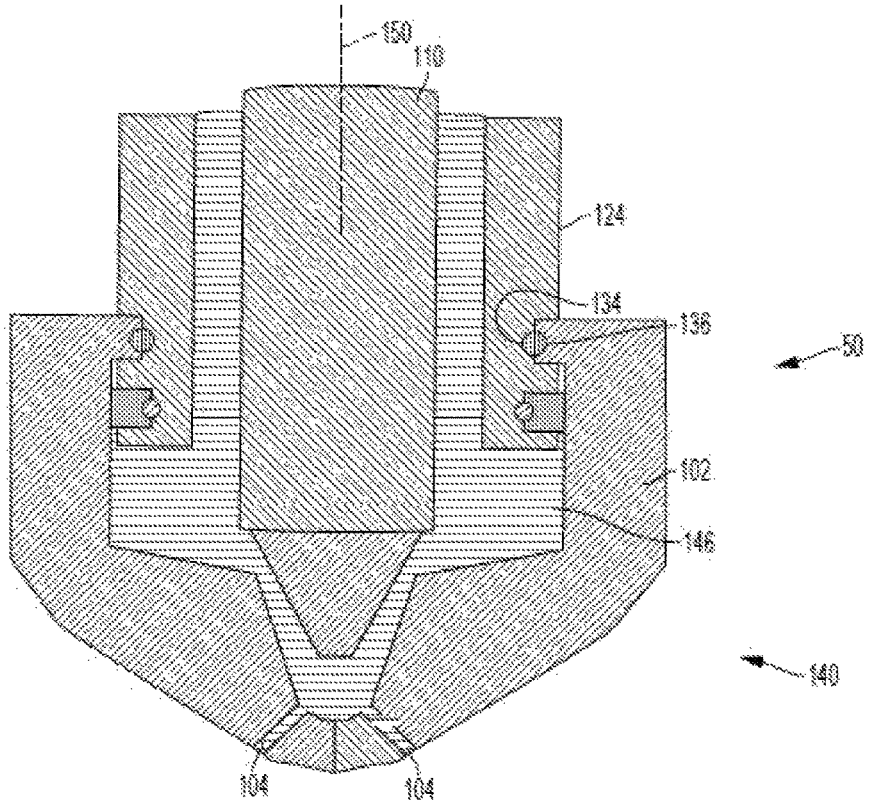
FIG. 5 is a cross-sectional diagram of second example fuel injector in a second position in accordance with the present disclosure.
Figure 6:
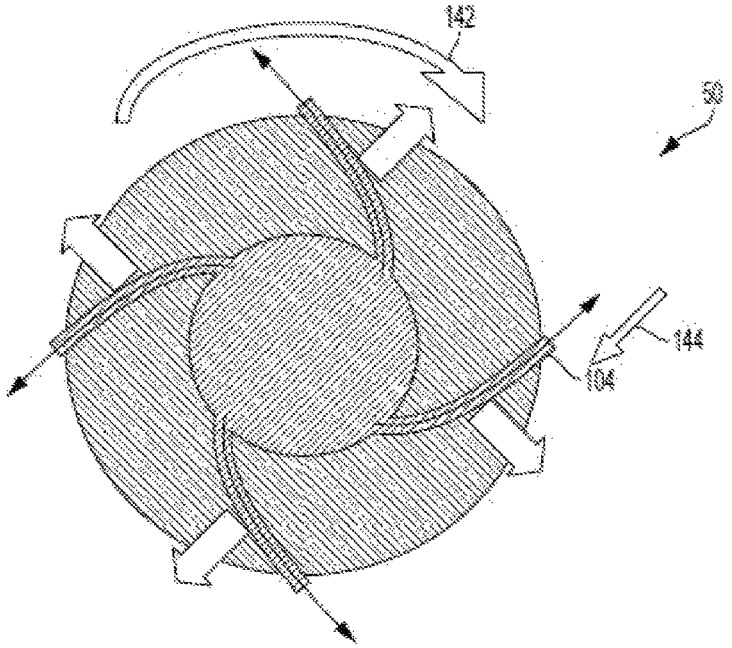
FIG. 6 is a cross-sectional diagram of the second example fuel injector shown in FIG. 5 cut along selected one or more plans to illustrate selected features in accordance with the present disclosure.

FIGS. 3-4 illustrate a second example fuel injector 50 in a first position 138, and FIGS. 5-6 illustrate a second example fuel injector in a second position 140 in accordance with the present disclosure. Embodiments may include an injector body 124 that may have a passage therethrough through which the injector needle 110 may be disposed. The nozzle body 102 and the injector body 124 may be engaged for rotational movement therebetween, as illustrated with arrow 142. An annular slot 134 may be defined on one or both of the nozzle body 102 and the injector body 124. A retention spring may be 136 located in the annular slot 134.

In various embodiments, the movement of the nozzle body in a direction from the first position 138 to the second position 140 is rotational movement of the nozzle body 142 which may be effected by a reactionary force 144 caused by the spraying of fuel from the one or more nozzles 104. Embodiments may include a biasing mechanism 136 to bias the rotational movement of the nozzle body in a direction opposite the reactionary force to effect movement of the nozzle body in a direction from the second position to the first position.

Figure 7A:
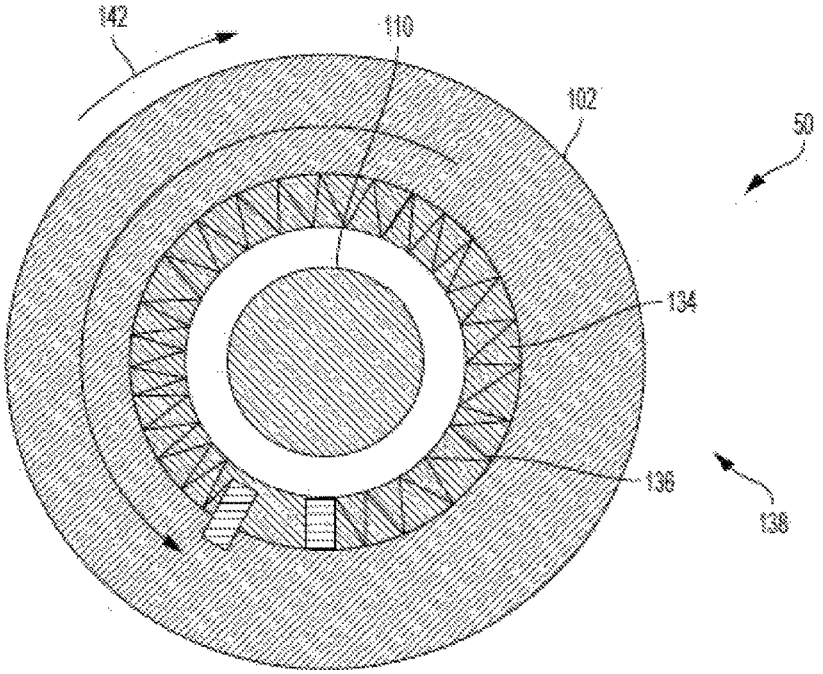
FIG. 7A is a cross-sectional diagram of the second example fuel injector cut along the line A-A in FIG. 3 with a portion of the injector shown in a first angular position.
Figure 7B:
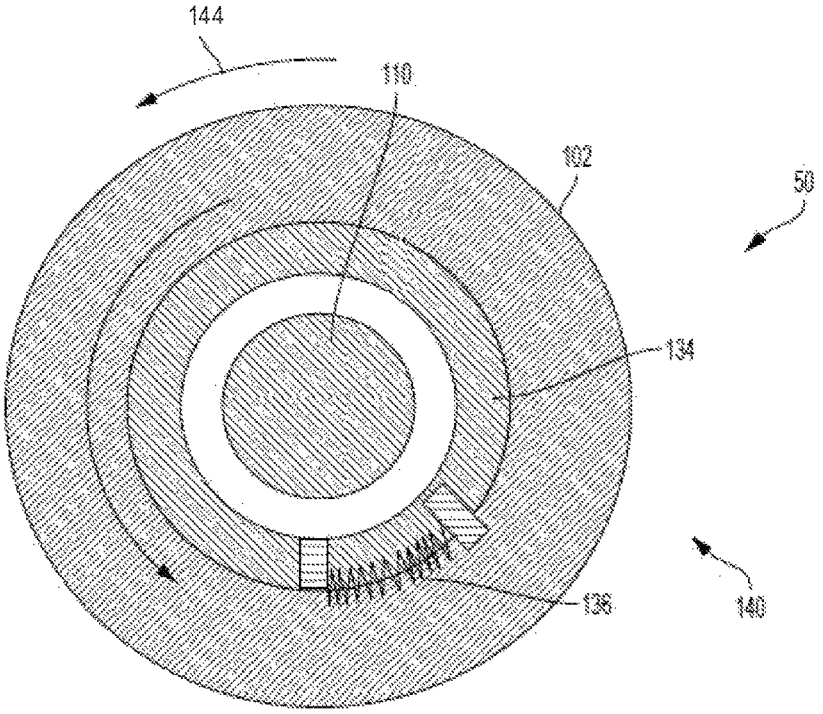
FIG. 7B is a cross-sectional diagram of the second example fuel injector cut along the line A-A in FIG. 3 with a portion of the injector shown in a second angular position

Referring now also to FIGS. 7A and 7B wherein FIG. 7A is a cross-sectional diagram of the second example fuel injector 50 cut along the line A-A in FIG. 3 showing the nozzle body 102 in a first angular position 138 relative to the injector body 124, and FIG. 7B is a cross-sectional diagram of the second example fuel injector cut along the line A-A in FIG. 3 with a portion of the injector shown in a second angular position 140. In various embodiments, the movement of the nozzle body 102 may be rotational movement of the nozzle body, as illustrated by arrow 142 effected by a reactionary force 144 caused by the spraying of fuel from the one or more nozzles; and further comprising a biasing mechanism 136 to provide a force opposite the reactionary force.

Figure 8:
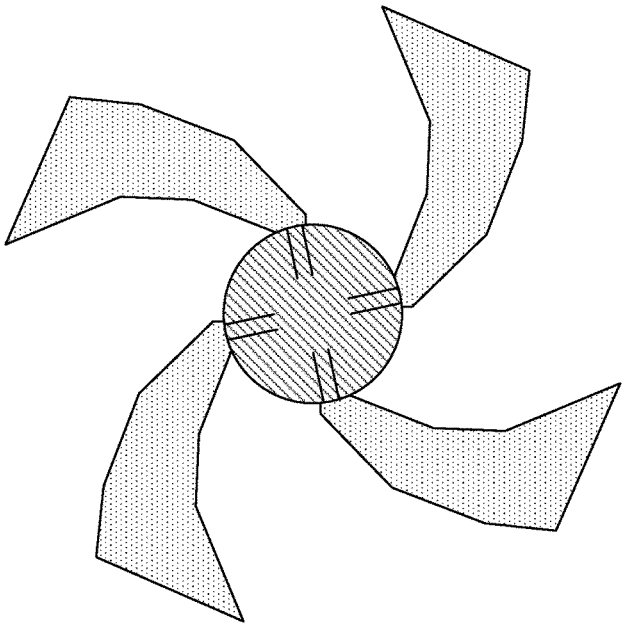
FIG. 8 is a cross-sectional diagram through a tip portion of an example fuel injector showing also an example spray pattern that may be possible in accordance with the present disclosure.
Figure 9:
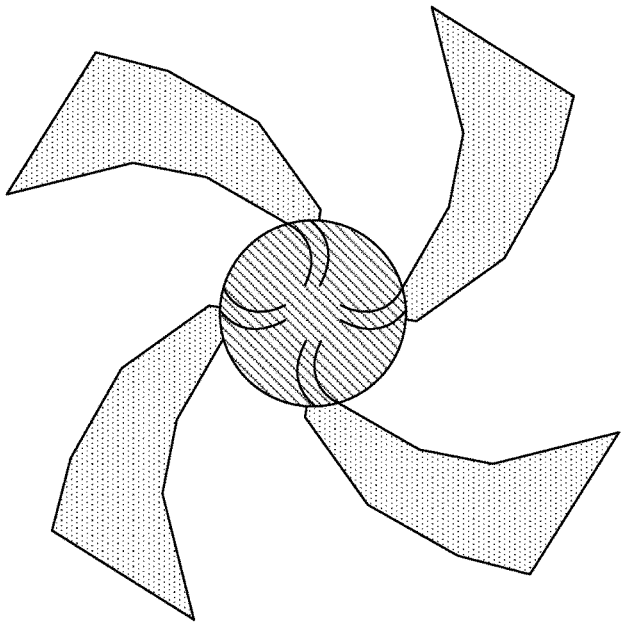
FIG. 9 is a cross-sectional diagram through a tip portion of another example fuel injector showing also an example spray pattern that may be possible in accordance with the present disclosure.

FIG. 8 is a cross-sectional diagram through a tip portion of an example fuel injector showing also an example spray pattern that may be possible in accordance with the present disclosure. FIG. 9 is a cross-sectional diagram through a tip portion of another example fuel injector showing also an example spray pattern that may be possible in accordance with the present disclosure.

Various embodiments may provide a fuel injector arrangement 50 including an injector body 124 configured to at least partially house a fuel chamber 146 for a high pressure fuel 103. A nozzle body 102 may be coupled with the injector body 124 and may have one or more nozzles 104.

An injector needle 110 may be disposed at least partially within the fuel chamber 146 and may be configured for axial movement relative to the nozzle body 124. The injector needle 110 and the nozzle body 124 may be configured for mutual contact, at for example a seating line 118 to prevent fluid communication between the fuel chamber 146 and the one or more nozzles 104. The injector needle 110 and the nozzle body 102 may also be configured for incremental spaced apart positioning to provide increasing fluid communication between the fuel chamber 146 and the one or more nozzles 104. The one or more nozzles 104 may be configured to experience repeatable movement substantially corresponding to and substantially determined by the relative axial movement of the injector needle 110 and the nozzle body 102.

In various embodiments the repeatable movement may be one or more of: rotational movement 142 from a first position 138 to a second position 140 and the one or more nozzles 104 may be configured to return to the first position 106 when the injector needle and the nozzle body are returned to a state of mutual contact; translational movement from the first position 106 to the second position 108 and the one or more nozzles is configured to return to the first position 106 when the injector needle and the nozzle body are returned to a state of mutual contact; and spiral shaped movement that may include a first component defined by at least some of the rotational movement and a second component defined by at least some of the translational movement from the first position to the second position and the one or more nozzles may be configured to return to the first position when the injector needle and the nozzle body are returned to a state of mutual contact.

In various embodiments the rotational movement from the first position 138 to the second position 140 is effected by a tangential reactionary force 144 exerted on the nozzle body 102 by a thrust created when some of the high pressure fluid is sprayed from the one or more nozzles 104. In some embodiments the rotational movement from the second position 140 to the first position 138 is effected by a biasing force of a spring 136 disposed in an annular groove 134 formed in one or both of the injector body 124 and the nozzle body 102.

In various embodiments the translational movement may be an axial movement of the nozzle body along an injector axis 150 that may be enabled by a threaded engagement 127 between the injector body 124 and the nozzle body 102. The translational movement may be effected by a relative rotational movement 130 between the nozzle body 102 and injector body 124.

The translational movement may be an axial movement of the nozzle body 124 along the injector axis 150 enabled by a threaded engagement 127 between the injector body 124 and the nozzle body 102 and may effected by rotational movement of the nozzle body 124 wherein the nozzle body may be fixed to a cylinder head 60 of an engine 10.

FIGS. 2-9 are drawn to scale, although other relative dimensions may be used, if desired.

The figures herein show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. For example, illustration of components directly coupled to one another, without any intervening components therebetween, may be distinct from components coupled together through an intermediary component. As another example, the figures may illustrate voids and spaces where there is no structural component of the device, enabling one or more components to be spaced away from one another and/or separate from one another by an unoccupied space. Additionally, Figures shows certain components may in one example have only those components shown and not additional components.

Figure 10:
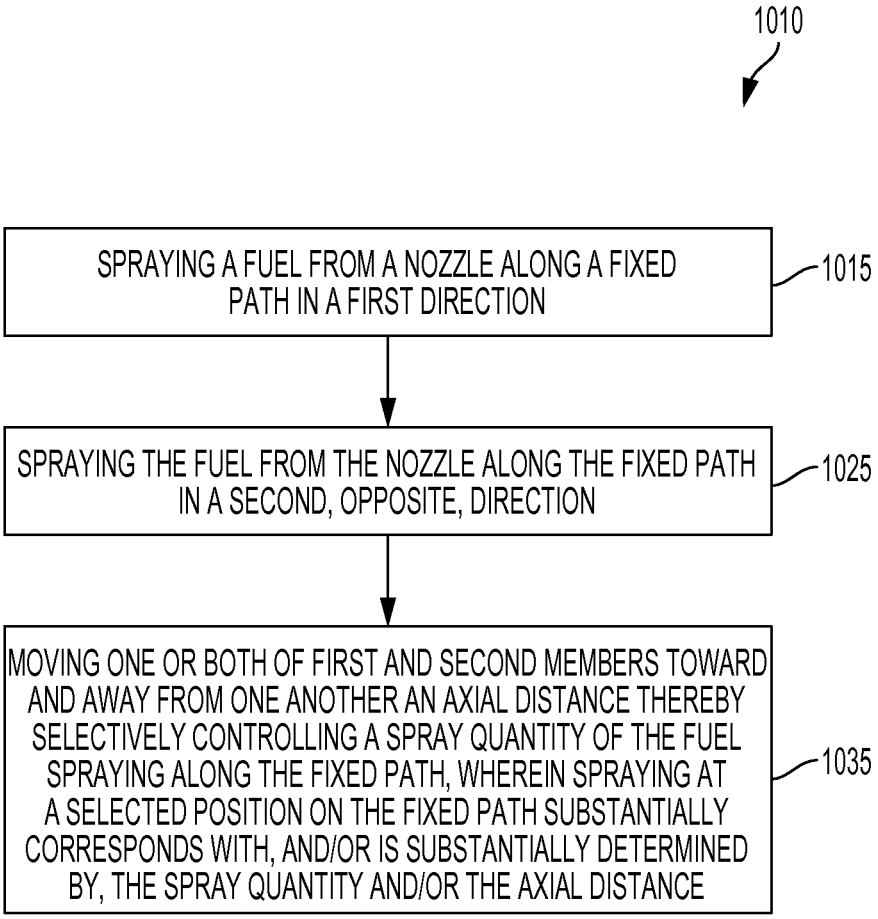
FIG. 10 is a flow diagram illustrating an example method in accordance with the present disclosure.

FIG. 10 is a flow diagram illustrating an example method 1010 in accordance with the present disclosure. The method 1010 may include, at 1015, spraying a fuel from a nozzle along a fixed path in a first direction. The method 1010 may also include, at 1025, then spraying the fuel along the fixed path in a second direction. The second direction may be opposite the first direction. The method 1010 may also include, at 1035, moving one or both of first and second members toward and away from one another an axial distance thereby selectively controlling a spray quantity of the fuel spraying along the fixed path. The spraying at a selected position on the fixed path may substantially correspond with, and/or may be substantially determined by, the spray quantity and/or the axial distance.

With various example methods the spraying along the fixed path 1015, 1025 may be one or both of: spraying along an axial path; and spraying along a partial discoid and/or frusta-conical shaped path caused by a rotational movement of a mouth of the nozzle.

With various example methods the spraying the fuel from the nozzle along the fixed path in the first direction is spraying from a first position to a second position. And the spraying the fuel from the nozzle along the fixed path in the second direction is spraying from the second position to the first position.

The method 1010 may also include, attaching the injector body to a cylinder head; providing an nozzle body for the nozzle configured for rotation. The nozzle may be defined in the nozzle body via passages or the like. The method may also include, providing threaded engagement between the injector body and the nozzle body; and effecting axial movement of the nozzle body by rotating the nozzle body.

With various example methods the spraying the fuel from the nozzle along the fixed path in the first direction includes allowing rotational movement in a first rotational direction effected by a reactionary force caused by the spraying of the fuel from the one or more nozzles. The method may also include biasing the nozzle body against the reactionary force, wherein the spraying the fuel from the nozzle along the fixed path in the second direction includes biasing the nozzle for rotation in a second rotational direction opposite the first rotational direction. The biasing the nozzle body may include positioning a spring at least partially in an annular slot in the nozzle body.

It should be understood that the systems and methods described herein are exemplary in nature, and that these specific embodiments or examples are not to be considered in a limiting sense, because numerous variations are contemplated. Accordingly, the present disclosure includes all novel and non-obvious combinations of the various systems and methods disclosed herein, as well as any and all equivalents thereof.

The invention claimed is:

1. A method comprising:

spraying fuel from a nozzle along a fixed path in first and second directions, the second direction being opposite the first direction; and moving a nozzle body an axial distance along a threaded engagement between the nozzle body and an injector body, where moving the nozzle body the axial distance moves the nozzle body toward and away from an injector needle, where the nozzle body is moved the axial distance along the threaded engagement by rotation of the injector body to control a spray quantity of fuel spraying along the fixed path, where the injector body is rotated via a motor, the spraying only at a selected position on the fixed path that is determined by the axial distance.

2. The method of claim 1, wherein the spraying along the fixed path is one or more of:

spraying along a spiral path;

spraying along an axial path; and spraying along a partial discoid and/or frusta-conical shaped path caused by a rotational movement of a mouth of the nozzle.

3. The method of claim 1, wherein the spraying the fuel from the nozzle along the fixed path in the first direction is spraying from a first position to a second position, and wherein the spraying the fuel from the nozzle along the fixed path in the second direction is spraying from the second position to the first position.

4. The method of claim 1, wherein the injector body is attached to a cylinder head.

* * * * *